US006926812B2

(12) United States Patent
Ohba

(10) Patent No.: US 6,926,812 B2
(45) Date of Patent: Aug. 9, 2005

(54) ELECTRIC FEEDING METHOD AND APPARATUS FOR A CONTINUOUS PLATING APPARATUS

(76) Inventor: Kazuo Ohba, 2-3, Matsubacho 4-chome, Higashimatsuyama-shi, Saitama (JP)

( * ) Notice: Subject to any disclaimer, the term of this patent is extended or adjusted under 35 U.S.C. 154(b) by 521 days.

(21) Appl. No.: 10/224,954

(22) Filed: Aug. 21, 2002

(65) Prior Publication Data

US 2002/0189934 A1 Dec. 19, 2002

Related U.S. Application Data

(60) Division of application No. 09/707,267, filed on Nov. 6, 2000, now Pat. No. 6,471,846, which is a continuation-in-part of application No. 09/209,362, filed on Dec. 11, 1998, now abandoned.

(30) Foreign Application Priority Data

Sep. 25, 1998 (JP) ..... 10-271673

(51) Int. Cl.[7] ..... C25D 17/00

(52) U.S. Cl. ..... 204/199; 204/200; 204/212; 204/215; 204/218; 204/252

(58) Field of Search ..... 204/199, 200, 204/212, 215, 218, 252

(56) References Cited

U.S. PATENT DOCUMENTS 5,914,016 A * 6/1999 Schmid ..... 204/201
6,471,846 B1 * 10/2002 Ohba ..... 205/137

* cited by examiner

*Primary Examiner*—Arun S. Phasge
(74) *Attorney, Agent, or Firm*—Flynn, Thiel, Boutell & Tanis, P.C.

(57) ABSTRACT

To avoid the formation of undesirable plating on electric supply rollers, there is provided a continuous plating apparatus in which a planar article to be plated is vertically clamped on both sides by electric supply rollers and the article to be plated is moved horizontally in a plating bath by the rotation of the electric supply rollers to plate both surfaces of the article to be plated. The apparatus is characterized in that the electric supply rollers are divided into conductive segments and non-conductive segments in the circumferential direction, with only the conductive segment which is in contact with the article to be plated being negatively charged, and other conductive segments which are at a distance from the article being positively charged.

4 Claims, 7 Drawing Sheets

ELECTRIC FEEDING METHOD AND APPARATUS FOR A CONTINUOUS PLATING APPARATUS

This application is a division of U.S. Ser. No. 09/707,267, filed Nov. 6, 2000 now U.S. Pat. No. 6,471,846, which is a continuation-in-part application of U.S. Ser. No. 09/209,362, filed on Dec. 11, 1998 now abandoned.

BACKGROUND OF THE INVENTION

1. Field of the Invention

The present invention relates to an electric feeding method and apparatus for a continuous plating apparatus for continuously feeding electric power to articles to be plated.

2. Description of the Related Art

Conventionally, in order to plate planar articles, a plurality of articles to be plated are individually mounted by fasteners on a frame member connected to cathodes, and the articles are removed individually after the completion of plating. However, this method is time-consuming, and causes a hindrance against plating work.

Therefore, recently, an approach has been proposed in which, without fixing the articles to the frame member, the articles to be plated are continuously fed into a plating bath one by one, and the articles to be plated are moved in a vertical direction within the plating bath to thereby continuously effectively plate the articles.

FIG. 7 is a cross-sectional view showing an example of a continuous plating apparatus that may perform continuous plating. A V-shaped rail 2 in cross section extending in a vertical direction to the paper surface is provided in the vicinity of a central bottom of a plating bath 1. An article 3 to be plated such as a printed circuit board is held in the vertical direction with its lower edge being laid on the rail 2. Both surfaces of the article 3 are clamped by electric supply rollers 5 fixed to vertical rotary electrode shafts 4. The electric supply rollers 5 are rotated together with the rotary shafts 4 so that the article 3 to be plated is moved horizontally on and along the rail 2 under the condition that the article 3 is dipped in plating liquid 6. Then, anodes 8 which may move vertically by cylinders 7 and shielding plates 9 for preventing turbulence are provided in the plating liquid 6.

Wheels 10 are mounted at suitable positions of the rotary shafts 4 and pressing members 12 pressed by springs 11 are brought into contact with the wheels 10. The pressure force of the springs 11 is transmitted from the wheels 10 through the rotary electrode shafts 4 to the electric supply rollers 5 so that the contact between the electric supply rollers 5 and the article 3 to be plated is ensured and the flow of the electricity to the surfaces of the article 3 is made uniform.

Thus, the surfaces of the article 3 to be plated are charged with a negative potential from the rotary electrode shafts 4 through the electric supply rollers 5 so that the current flows from the anodes 8 to perform the continuous plating.

The circumferential surfaces of the electric supply rollers 5 which are brought into contact with the articles 3 to be plated are coated with a protection film which is made of titanium nitride on, for example, a nickel plated film that is harder than the plating coating to be applied, such as a copper film. Brushes 14 are pressed against the circumferential surfaces of the electric supply rollers 5 by springs 13 so that the plating formed on the circumferential surfaces of the electric supply rollers 5 may be removed.

Since each of the conventional electric supply rollers 5 as a whole is formed into a single conductive member, the current always flows also through a portion which is out of contact with the article 3 to be plated and a plating is formed on the electric supply rollers 5 as a whole.

Even if the brushes 14 are depressed against the circumferential surfaces of the electric supply rollers 5 by the springs 13 as mentioned above, it is difficult to remove the plating adhered over the entire electric supply rollers 5. Due to the accumulated plating, the electric supply rollers 5 are damaged so that the serve life thereof is shortened. A current will not uniformly flow through the articles to be plated. As a result, it is impossible to perform the plating work.

SUMMARY OF THE INVENTION

According to the present invention, an electric feeding method of continuously electroplating a planar article comprising:

providing a plating apparatus having an anode, a cathode for flaking, and at least two rotary electrode shafts, each of said rotary electrode shafts having at least one electric supply roller mounted thereon;

dividing each of the electric supply roller in a circumferential direction into at least one conductive segment and at least one non-conductive segment;

clamping both sides of the planar article by the electric supply rollers such that the planar article is vertical;

moving the planar article horizontally through the plating apparatus by the rotation of the electric supply rollers;

electrically charging said at least one electric supply roller of said rotary electrode shafts so that the conductive segment in contact with the planar article has a negative potential; and electrically charging said at least one electric supply roller of said rotary electrode shafts so that the conductive segment at a distance from the planar article has a positive potential, and an electric current flows between the cathode and the conductive segment which has the positive potential; is provided.

In the claimed method, the electric supply roller is divided into conductive and non-conductive segments and a planar article is plated by supplying a negative charge only to the conductive segment in contact with the planar article. The non-conductive segment and the conductive segment not in contact with the article of the same electric supply roller are prevented from undesirable plating. On the other hand, when the segment comes around to the opposite side of the electric supply roller by its rotation, a positive charge is supplied to the conductive segment. Thus, undesirable plating, which has adhered on the conductive segment charged negatively, elutes or flakes into a plating liquid so that the undesirable plating can be removed. Accordingly, the electric supply roller can be used for a longer term and the planar article can be uniformly plated by allowing a uniform electric current to flow to the planar article.

When the conductive segment of the electric supply roller rotates to the place at a distance from the planar article, an electric current flows between the conductive segment having a positive potential and the cathode, which pairs with the conductive segment. The cathode is provided in order to attract metal flakes, which are removed from the electric supply roller. The electric current flow is formed by supplying positive and negative charges from the same eliminator to the conductive segment and the cathode, respectively. The current flow results in drawing metallic flakes removed from the electric supply roller to the cathode, thus, the formation of a granulated surface by adhesion of the flakes on the plating face can be prevented.

Moreover, in the method of the present invention, a planar article is sandwiched between a pair of electric supply rollers so that the planar article is positioned vertically and conveyed by the pair. When a planar article has via holes, air inside them spontaneously flows out because of the rendering of the planar article vertical. Then, the insides of the via holes can be easily plated.

An electrical collection disk may be provided on an upper portion of each rotary electrode shaft, out of the plating liquid, in order to allow an electric current to flow to the electric supply roller. The electrical collection disk has conductive and non-conductive segments respectively corresponding to the conductive and non-conductive segments of the electric supply roller in phase in the circumferential direction. The electric supply roller and the electrical collection disk are fixed to the rotary electrode shaft in circumferential phase and are uniformly rotated by rotation of the shaft. Thereby, the electric supply roller can be efficiently charged via the rotary electrode shaft by contacting an electrode with the electrical collection disk.

The boundary between the conductive segment and the non-conductive segment is desirably formed to be vertical in the side face of the electric supply roller. In other words, it is desirable that each corner of the conductive segment is 90 degrees in the side face of the roller. If the corner of the conductive segment is an acute angle or the segment has a complex pattern in the side face, the undesirable plating thickens as the tip of the corner or the pattern narrows. Even if a positive charge is supplied to the conductive segment, a thick plating on the side face is likely to remain and all of the undesirable plating is hardly removed by supplying a positive charge. When the conductive segment, which has the remaining plating on the side face of the roller, rotates and contacts the planar article again, the undesirable plating causes flaws on the plating surface of the article. By forming the boundary between the conductive segment and the non-conductive segment to be vertical, if extra plating adheres near the boundary on the side face of the electric supply roller, the undesirable plating does not become so thick. Therefore, the undesirable plating can be efficiently removed by supplying a positive charge to the conductive segment.

When a positive charge is supplied for removing undesirable extra plating on the electric supply roller, pulsed current may be used. A large amount of pulsed current can flow at short-time intervals, although such a large amount of continuous current generates burst deposits on the electric supply roller. The pulsed current can efficiently flake the extra plating on the roller without forming burnt deposits, even if the undesirable plating is comparably thick. The pulsed current is desirably supplied at the rate of 9 A per 10 $dm^2$ of the surface to be plated. On the other hand, in the case of continuous current, 3 A per 10 $dm^2$ of the surface to be plated is preferable. The time-interval of the pulse is desirably set so that an integrated value of the pulsed current with respect to time is equal to a corresponding value of continuous current. For example, 1 ms of 9 A-current-carrying and 2 ms of keeping ground potential are alternately repeated as the pulsed current, in contrast with 3 A of current continuously flowing.

By the present invention, A continuous electroplating apparatus comprising:

a plating bath;

at least two rotary electrode shafts;

a rail between the rotary electrode shafts for mounting a planar article to be plated thereon;

an electric supply roller mounted on each of the rotary electrode shafts, the electric supply roller being divided into at least one conductive segment and at least one non-conductive segment;

an anode;

a cathode;

an electrical collection disk mounted on an upper portion of each of the rotary electrode shafts, the electrical collection disk corresponding to the electric supply roller mounted on the same rotary electrode shaft and having at least one conductive segment and at least one non-conductive segment in circumferential phase with the conductive segment and the non-conductive segment of the corresponding electric supply roller;

a first eliminator electrically connected to the conductive segment of the electric supply roller in contact with the planar article and to the anode; and a second eliminator electrically connected to the cathode and to the conductive segment of the electric supply roller at a distance from the planar article is provided. The plating apparatus of the present invention continuously plates planar articles according to the claimed electric feeding method.

The continuous plating apparatus of the present invention has two eliminators. The first eliminator supplies a negative charge to the conductive segment of the electric supply roller in contact with a planar article to be plated and a positive charge to the anode in a plating liquid. Then, a flow of metal ions is formed in the plating liquid so that the metal ions produced at the anode are attracted to the planar article, thereby, the article is efficiently plated. On the other hand, the second eliminator provides a negative charge to the cathode in the plating liquid and a positive charge to the conductive segment at a distance from the planar article. Another flow of charges is formed in the plating liquid so that extra plating flaked off from the electric supply roller is attracted to the cathode. The electric charges supplied by the eliminators may be continuous current or pulsed.

A plurality of the electric supply rollers which respectively have one conductive segment may be provided to each rotary electrode shaft. Or, one electric supply roller having a plurality of the conductive segments may be provided to each rotary electrode shaft. In the case of the plural electric supply rollers mounted on each rotary electrode shaft, the electric supply rollers are displaced to each other in phase in the circumferential direction by an angle of the conductive segment. Thereby, a conductive segment of one of the electric supply rollers mounted on the same shaft always contacts with the planar article to be plated and keeps electrically charging without breaks. Furthermore, a plurality of electrically contacting points on the surface of the planar article are provided by distributing the plural electric supply rollers in an equal interval on the rotary electrode shaft. Thereby, the electric charge is uniformly spread on the surface of the planar article and a uniform plating face is formed on the surface.

The cathode of the claimed plating apparatus may be enclosed by a diaphragm. The diaphragm is made of a material which is impermeable to metal ions. Providing the diaphragm can prevent the metal flakes, which are removed from the electric supply roller, from adhering to the cathode. Accordingly, the cathode can be used for a long period of time without frequent replacements.

DESCRIPTION OF THE PREFERRED EMBODIMENTS

An embodiment of the present invention will now be described with reference to the accompanying drawings.

Figure 1:
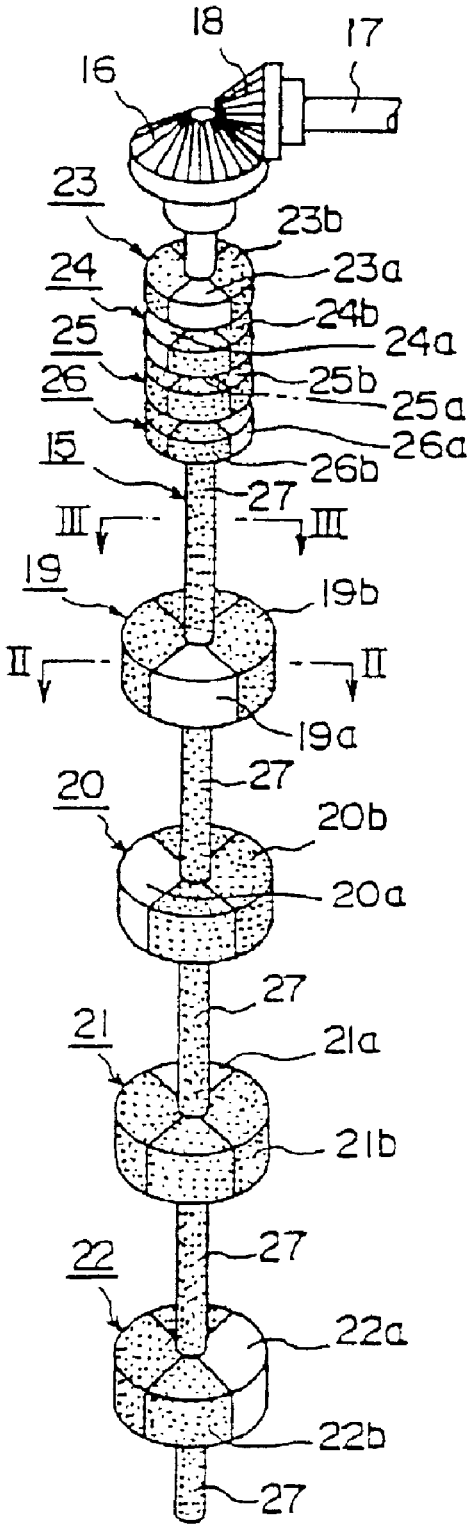
FIG. 1 is a perspective view showing an example of an embodiment of an apparatus used in the method to which the present invention is applied.

FIG. 1 is a perspective view showing an example of an apparatus used in the method to which the present invention is applied. A bevel gear 16 is mounted at an upper end of a vertical rotary electrode shaft 15 and is engaged with a bevel gear 18 mounted on a rotary drive shaft 17 to thereby rotate the rotary electrode shaft 15.

The portions of the rotary electrode shaft 15 below the position somewhat remote from the bevel gear 16 penetrate the centers of four flat and cylindrical, electric supply rollers 19, 20, 21 and 22. These four electric supply rollers 19, 20, 21 and 22 are spaced at intervals on the rotary electrode shaft 15. The portion of the rotary electrode shaft 15 just below the bevel gear 16 penetrates the centers of the same number (four, as that of the electric supply rollers) of electrical collection disks 23, 24, 25 and 26. The four electric supply rollers 19, 20, 21 and 22 are spaced at minute intervals on the rotary electrode shaft 15.

The outer circumferential surface of the rotary electrode shaft 15 between the electrical collection disk 26 and the electric supply roller 19 and the outer circumferential surfaces of the rotary electrode shaft 15 between the electric supply rollers 19, 20, 21 and 22 below the electric supply roller 19 are coated by a cover 27 of an insulation coating, such as a synthetic resin coating or the like, so that the rotary electrode shaft 15 is not brought into contact with the plating liquid.

Figure 2:
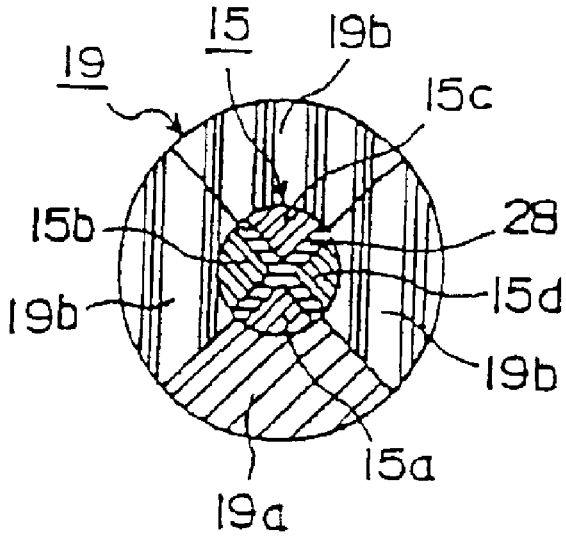
FIG. 2 is an enlarged cross-sectional view taken along the line II—II of FIG. 1.

As shown in an enlarged sectional view of FIG. 2, in the electric supply roller 19, a portion having a central angle of 90 degrees corresponding to one segment of four-divided segments in the circumferential direction is formed into a conductive segment 19*a* and the remaining portions having a central angle of 270 degrees corresponding to three segments of the four-divided segments in the circumferential direction of the electric supply roller 19 is formed into a non-conductive segment 19*b* made of a resin or the like.

In the same manner, in the other electric supply rollers 20, 21 and 22, portions each having a central angle of 90 degrees corresponding to one segment of the four-divided segments in the circumferential direction are formed into conductive segments 20*a*, 21*a* and 22*a*, respectively, and portions, each having a central angle of 270 corresponding to three segments of the four-divided segments in the circumferential direction of the electric supply rollers 20, 21 and 22 are formed into a non-conductive segments 20*b*, 21*b* and 22*b*, respectively.

The above-described conductive segments 19*a*, 20*a*, 21*a* and 22*a* are coated with a protective film and coated further with titanium nitride (having a nickel plate thickness of 5 μm or more containing phosphorous by 12% or more, a minimum nickel plate thickness of 3 μm or more containing phosphorous by 6% or more) on a non-electrolyte nickel plated coating film on a surface of, for example, copper, which is harder than the plated coating, such as copper, and as shown in FIG. 1, are fixed to the rotary electrode shaft 15 with a displacement to each other in phase in the circumferential direction by 90 degrees corresponding to the central angle. Thus, the phases in the circumferential direction of the non-conductive segments 19*b*, 20*b*, 21*b* and 22*b* are also displaced by 90 degrees.

Also, as shown in FIG. 1, the electrical collection disks 23, 24, 25 and 26 fixed just below the bevel gear 16 to the rotary electrode shaft 15 respectively include: the conductive segments 23*a*, 24*a* and 25*a* (which is hidden behind the electrical collection disk 24 in FIG. 1) whose central angle is displaced by 90 degrees in phase in the circumferential direction to each other and correspond to one of the four-divided segments in the circumferential direction in correspondence with the above-described electric supply rollers 19, 20, 21 and 22, and the non-conductive segments 23*b*, 24*b*, 25*b* and 26*b*, each having a central angle of 270 degrees corresponding to the three segments of the four-divided segments in the circumferential direction.

Figure 3:
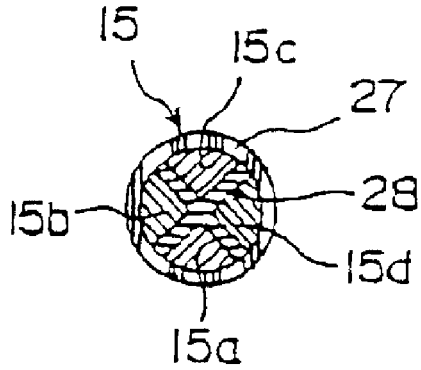
FIG. 3 is an enlarged cross-sectional view taken along the line III—III of FIG. 1.

The rotary electrode shaft 15 may be a long rod made of an integral material. However, as shown in FIGS. 2 and 3, the rod may be divided by 90 degrees in the circumferential direction into four segments, and may be divided into segments 15*a*, 15*b*, 15*c* and 15*d* sandwiching the electrically insulated material 28. In this case, the conductive segment 23*a* of the electrical collection disk 23 shown in FIG. 1 is electrically connected to the conductive segment 19*a* of the electric supply roller 19 through the segment 15*a* of the rotary electrode shaft 15. In the same manner, the conductive segments 24*a*, 25*a* and 26*a* of the electrical collection disks 24, 25 and 26 are electrically connected to the conductive segments 20*a*, 21*a* and 22*a* of the electric supply rollers 20, 21 and 22 through the segments 15*b*, 15*c* and 15*d* of the rotary electrode shaft 15, respectively.

Figure 4:
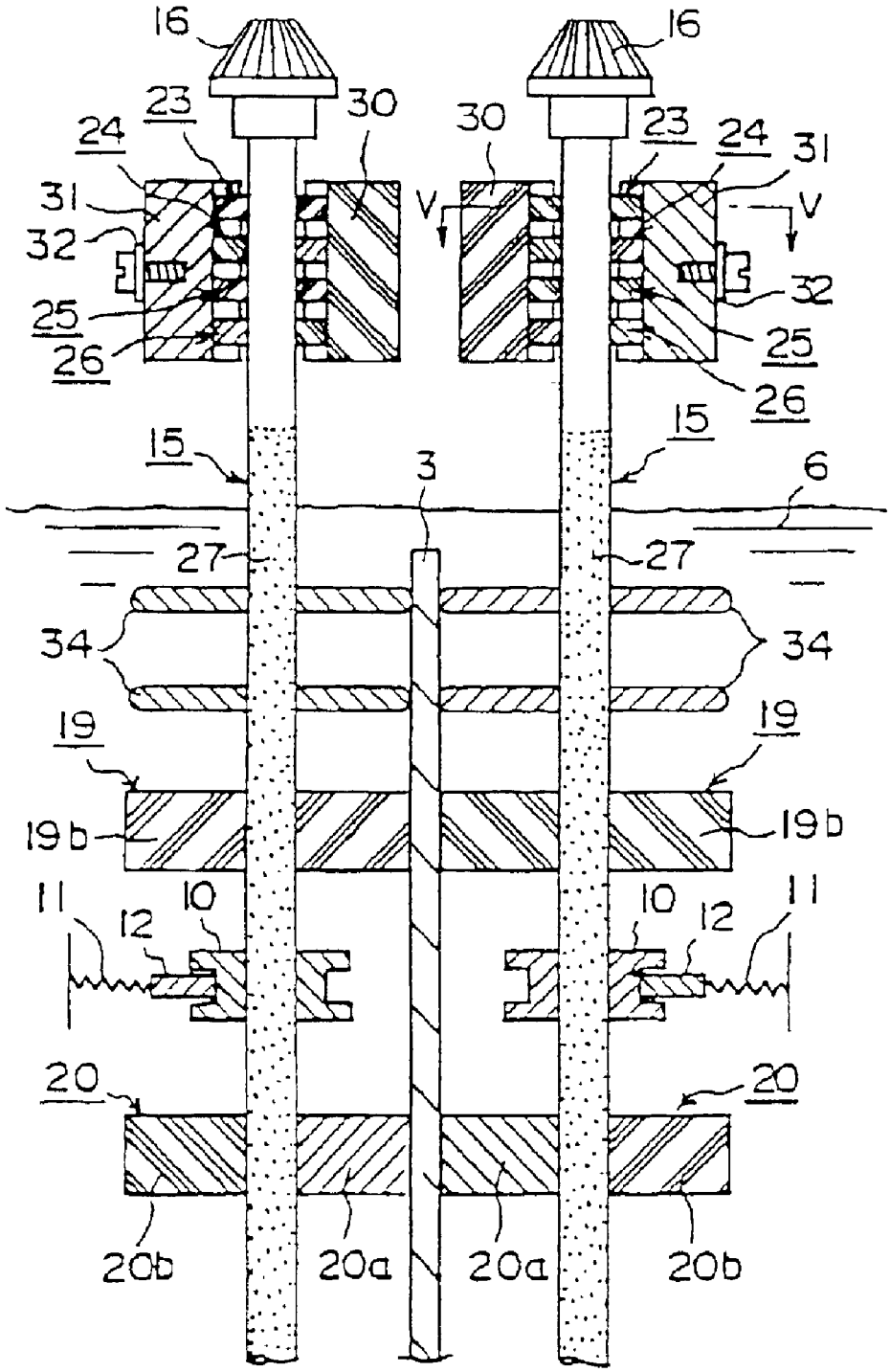
FIG. 4 is a longitudinal frontal view showing an electric supply condition according to the present invention.

FIG. 4 is a longitudinal frontal view showing an electric supply condition using the apparatus shown in FIG. 1. When the rotary electrode shaft 15 is rotated and the electrical collection disk 23 is rotated together with the rotary electrode shaft 15, during one turn of the electrical collection disk 23, the conductive segment 23*a* of the electrical collection disk 23 is brought into contact with the electric supply block 31 in the angular range of about 90 degrees corresponding to the central angle. At this time, the conductive segment 23*a* is kept under the condition that it is charged with a negative potential. To the contrary, when the conductive segment 23*a* rotates to the opposite of the electric supply block 31, the segment 23*a* is brought into contact with another electric supply block to be charged with a positive potential.

As shown in FIG. 4, in the same manner, the other electrical collection disks 24, 25 and 26 are sandwiched on both sides by the insulating blocks and are always in intimate contact with the electric supply block 31 and the other. Thus, the respective conductive segments 23*a*, 24*a*, 25*a* and 26*a* (see FIG. 1) of the electrical collection disks 23, 24, 25 and 26 are charged with a negative potential or a positive potential at a rotational phase difference of 90 degrees during their rotation together with the rotary electrode shaft 15.

Figure 7:
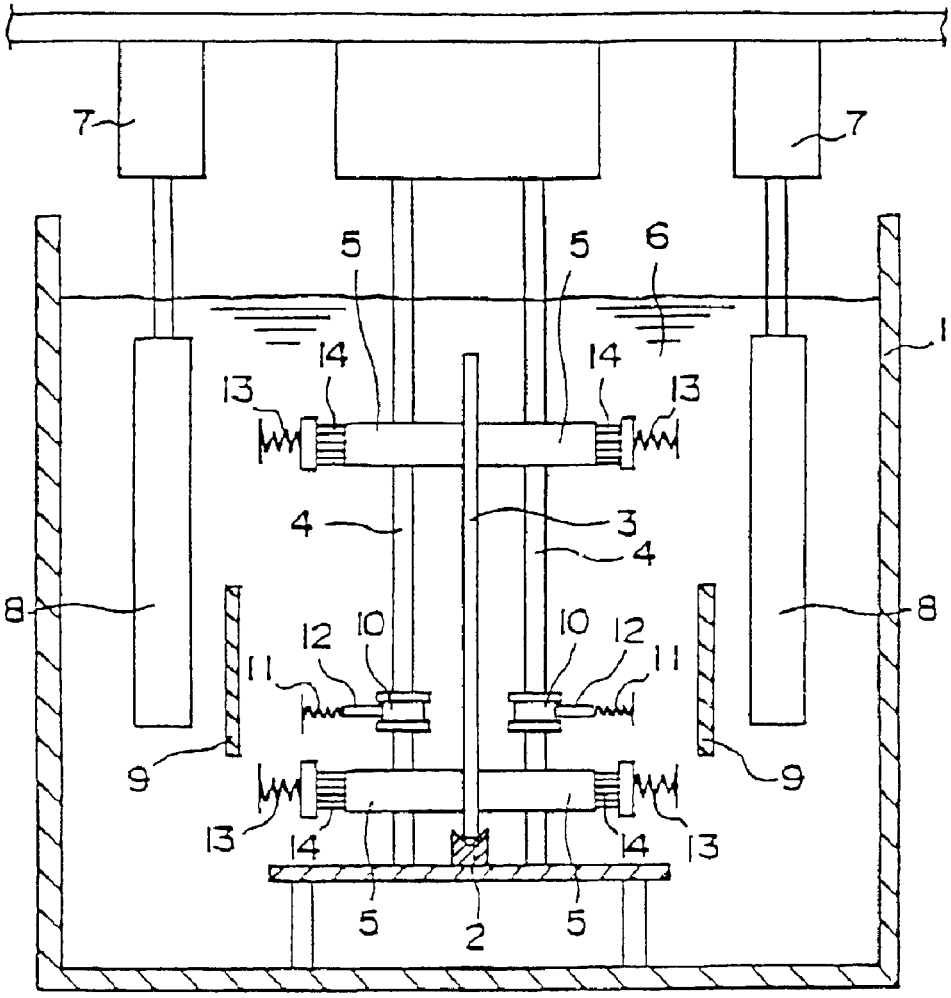
FIG. 7 (PRIOR ART)
FIG. 7 is a longitudinal frontal view showing an example of a conventional continuous plating apparatus.

In the same manner as in the conventional case shown in FIG. 7, the article to be plated with the lower edge laid on the V-shaped rail 2 in cross section provided in the vicinity of the central bottom of the plating bath 1 is sandwiched on both sides by the above-described electric supply rollers 19, 20, 21 and 22 as shown in FIG. 4.

Incidentally, as shown in FIG. 4, the rotary electrode shaft 15 is disposed so that the portions with covers 27, such as a synthetic resin coating or the like, are dipped into the plating liquid 6. Guide rollers 34 are suitably provided. The pressing member 12 is depressed by the springs 11 against the wheels 10 mounted at suitable positions. As a result, the contact among the electric supply rollers 19, 20, 21 and 22, the guide rollers 34 and the article 3 to be plated is ensured.

When the rotary electrode shaft 15 is rotated through the bevel gear 16, the electrical collection disks 23, 24, 25 and 26, the guide rollers 34, the electric supply rollers 19, 20, 21 and 22 and the wheels 10 are rotated in accordance with the rotation of the rotary electrode shaft 15. The article 3, to be plated, is clamped by the guide rollers 34 and the electric supply rollers 19, 20, 21 and 22 on both sides and is moved horizontally in the plating bath.

As described above, the conductive segments 23*a*, 24*a*, 25*a* and 26*a* of the electrical collection disks 23, 24, 25 and 26 are electrically connected to the conductive segments 19*a*, 20*a*, 21*a* and 22*a* of the electric supply rollers 19, 20, 21 and 22 through the rotary electrode shaft 15, respectively. The respective conductive segments 23*a*, 24*a*, 25*a* and 26*a* of the electrical collection disks 23, 24, 25 and 26 are charged with a negative potential or a positive potential at a rotational phase difference of about 90 degrees. Accordingly, the conductive segments 19*a*, 20*a*, 21*a* and 22*a* of the electric supply rollers 19, 20, 21 and 22 are also charged with a negative potential or a positive potential at a rotational phase difference of about 90 degrees.

The rotational phase when the conductive segments 19*a*, 20*a*, 21*a* and 22*a* of the electric supply rollers 19, 20, 21 and 22 are charged with the negative potential is in a direction in which the portions are in contact with the article 3 to be plated, and the portions are fixed to the rotary electrode shaft 15, whereby the conductive segments 19*a*, 20*a*, 21*a* and 22*a* of the electric supply rollers 19, 20, 21 and 22 are charged with a negative potential only when these portions are brought into contact with the article 3 to be plated and are charged with a positive potential when the portions are not brought into contact with the article 3 to be plated.

Thus, extra plating is prevented from being generated on the electric supply rollers 19, 20, 21 and 22 and can be flaked from the rollers so that the rollers may be used for a long period of time. Since the portion of the rotary electrode shaft 15 dipped in the plating liquid 6 is coated by the cover 27, the plating is not generated thereon at all.

Figure 5:
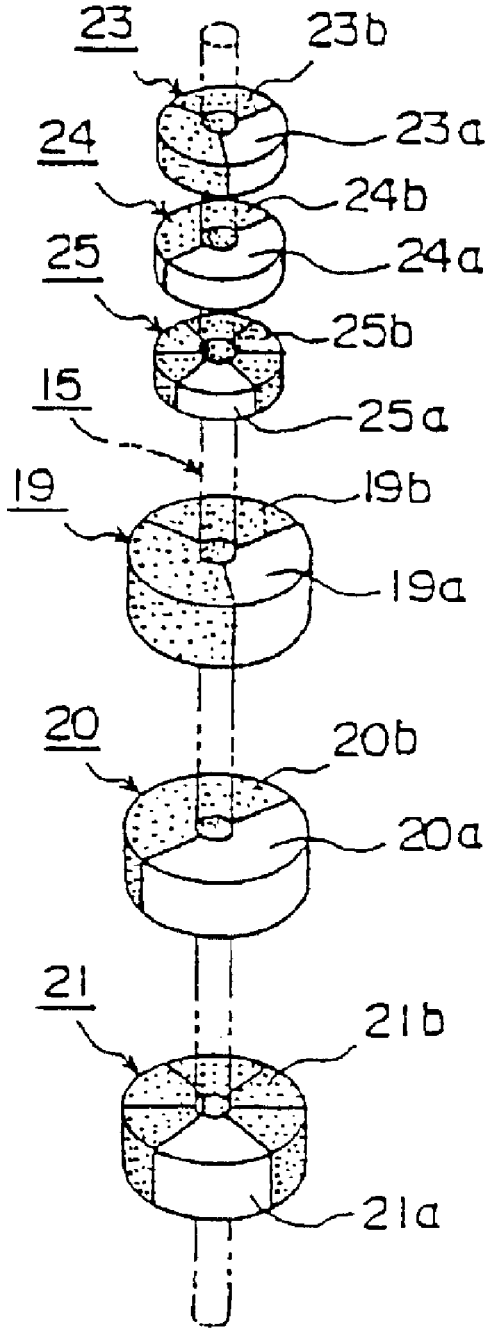
FIG. 5 is a perspective view showing an example of another embodiment of electric supply rollers and electrical collection disks used in the continuous plating apparatus according to the present invention.

FIG. 5 is a perspective view showing an example of another embodiment of electric supply rollers and electrical collection disks used in the continuous plating apparatus according to the present invention. A portion of the electric supply roller 19 having a central angle of 120 degrees corresponding to one of three-divided segments in the circumferential direction is formed into a conductive segment 19*a*. The remaining portion having a central angle of 240 degrees corresponding to two of the three-divided segments in the circumferential direction is formed into a non-conductive segment 19*b*. Then, in the same manner, for the electrical collection disks 23, the portion having a central angle of 120 degrees corresponding to one of the three-divided segments in the circumferential direction is formed into a conductive segment 23*a* and the remaining portion having a central angle of 240 degrees corresponding to the two of the three-divided segments in the circumferential direction is formed into a non-conductive segment 23*b*. The conductive segments 19*a* and 23*a* are fixed to the rotary electrode shaft 15 at an identical phase in the circumferential direction.

Also, in the electric supply roller 20, one of the two-divided segments in the circumferential direction is used as the conductive segment 20*a* and the other segment is used as the non-conductive segment 20*b*. Also, in the same manner, in the electrical collection disk 24, one of the two-divided segments in the circumferential direction is used as the conductive segment 24*a*, and the other segment is used as the non-conductive segment 24*b*. The conductive segments 20*a* and 24*a* are fixed to the rotary cathode electrode 15 at an identical phase in the circumferential direction.

Furthermore, in the electric supply roller 21, a portion having a central angle of 60 degrees corresponding to one segment of six-divided segments in the circumferential direction is formed into a conductive segment 21*a*, and the remaining portion having a central angle of 300 degrees corresponding to the five segments of the six-divided segments in the circumferential direction is formed into a non-conductive segment 21*b*. Then, corresponding to this, in the electrical collection disk 25, a portion having a central angle of 60 degrees corresponding to one of the six-divided segments in the circumferential direction is formed into a conductive segment 25*a* and the remaining portion having a central angle of 300 degrees corresponding to five of the six-divided segments in the circumferential direction is used as a non-conductive segment 25*b*. The conductive segments 21*a* and 25*a* are fixed to the rotary electrode shaft 15 at an identical phase in the circumferential direction.

In the case where the electric supply roller 19 and the electrical collection disk 23 shown in FIG. 5 are used, three rollers for each of them are fixed to the single rotary electrode shaft 15 and displaced in phase in the circumferential direction by 120 degrees. In the case where the electric supply roller 20 and the electrical collection disk 24 are used, two rollers for each of them are fixed to the single rotary electrode shaft 15 and displaced in phase in the circumferential direction by 180 degrees. In the case where the electric supply roller 21 and the electrical collection disk 25 are used, six rollers for each of them are fixed to the single rotary electrode shaft 15 and displaced in phase in the circumferential direction by 60 degrees.

Also, in the embodiment shown in FIG. 5, the conductive segments 19*a*, 20*a* and 21*a* are charged with the negative potential only when the conductive segments 19*a*, 20*a* and 21*a* are in contact with the article 3 to be plated (see FIG. 4). The conductive segments 19*a*, 20*a* and 21*a* are charged with a positive potential when the conductive segments 19*a*, 20*a* and 21*a* are out of contact with the article 3 to be plated so that an extra plating is removed.

Figure 6:
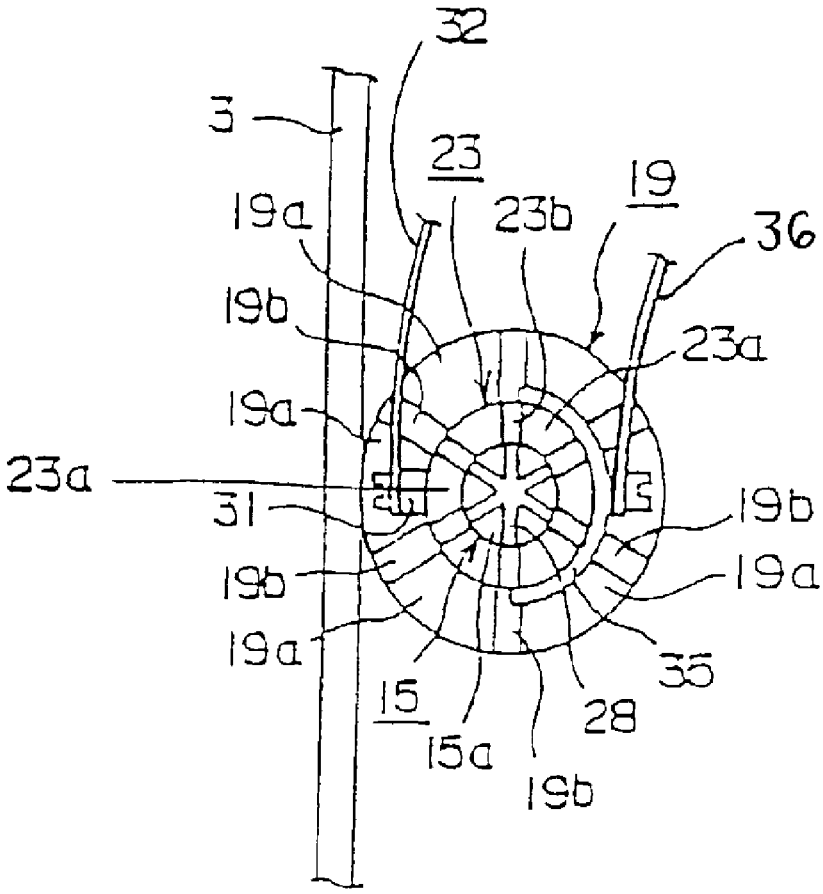
FIG. 6 is a partial plane view showing another example of the electric supply condition.

FIG. 6 is a partial plane view showing another example of the electric supply condition. The electric supply roller 19 is divided into six conductive segments 19*a* in the circumferential direction by a thin electrical insulator 19*b*. Corresponding to this, the electrical collection disk 23 is divided into six conductive segments 23*a* by a thin insulator 23*b*. Furthermore, the rotary electrode shaft 15 is also divided into six segments 15*a* in the circumferential direction sandwiching electrically insulating material 28.

Therefore, the conductive segment 19*a* of the electric supply roller 19 and the conductive segment 23*a* of the electrical collection disk 23 having the same phase in the circumferential direction are electrically connected through the segments 15*a* of the rotary electrode shaft 15, respectively.

The electric supply block 31 is brought into contact with the conductive segment 23*a* of one segment of the electrical collection disk 23 having a rotational phase directed to the article 3 to be plated and is charged with a negative potential by the lead line 32. The conductive segments 23*a* of three segments located in the rotational phase opposite the article 3 to be plated are brought into contact with the electric supply block 35 and are charged with a positive potential by a lead line 36.

The positive potential and the negative potential are transmitted to the conductive segment 19*a* of the electric supply roller 19 located at the same phase in the circumferential direction through the segment 15*a* of the rotary electrode shaft 15. Only the conductive segment 19*a* of one segment of the rotational phase in contact with the article 3 to be plated out of the electric supply rollers 19 is charged with a negative potential. The conductive segment 19*a* of three segments in the rotational phase opposite the article 3 to be plated is charged with a positive potential.

Accordingly, the conductive segment 19*a* of the electric supply roller 19 is charged with a negative potential only when the roller is in contact with the article 3 to be plated. The roller is charged with a positive potential when the roller is in the rotational phase opposite the article 3 to be plated so that an extra plating does not adhere thereto. It is thus possible to use the roller for a long period of time as compared with the case when the roller is not charged positively.

Figure 8:
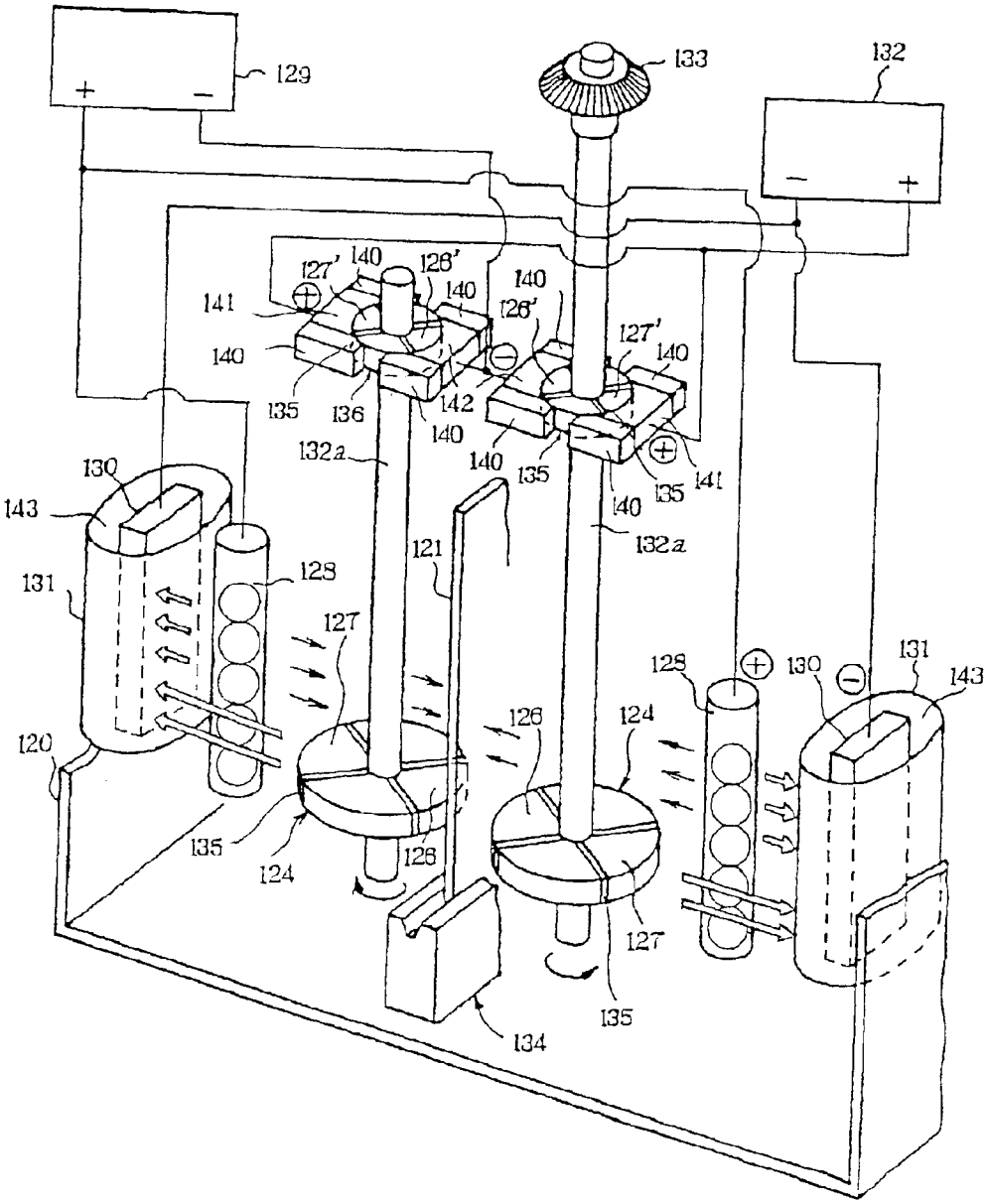
FIG. 8 is a partial perspective view of an example of an embodiment of the claimed continuous plating apparatus.

An example of another embodiment of the present invention is explained using FIG. 8. The continuous plating apparatus shown in FIG. 8 comprises at least two rotary electrode shafts 132*a*, 132*a* and an electric supply roller 124 mounted on each rotary electrode shaft 132*a*. A rail 134 for vertically supporting a planar article 121 to be plated thereon is provided between the rotary electrode shafts 132*a*, 132*a*. The planar article 121 is sandwiched between the electric supply rollers 124, 124 and the article 121 is conveyed by the rotation of the rollers 124, 124 along the rail 134. The electric supply roller 124 is divided into conductive segments such as 126 and 127 and non-conductive segments 135. The conductive segment 126, which is in contact with the planar article 121, is electrically connected with a conductive segment 126' of an electrical collection disk 136 mounted on an upper portion of the shaft 132*a*. The segment 126' corresponds to the segment 126 of the electric supply roller 124 and rotates in phase with the segment 126. The conductive segments 126 are supplied a negative potential via the segment 126', which is brought into contact with a negative electrode 142. On the other hand, the conductive segment 127, which is at a distance from the planar article 121, is electrically connected with a conductive segment 127' of the electrical collection disk 136. The segment 127' corresponds to the segment 127 of the electric supply roller 124 and rotates in phase with the segment 127. Accordingly, the conductive segments 127 are supplied a positive charge via the segment 127', which is in contact with a positive electrode 141. The positive electrode 141 and the negative electrode 142 are clamped with blocks 140, 140, which are made of an insulator. Moreover, an anode 128 and cathode 130 are provided in the plating bath of this continuous plating apparatus. The anode 128 includes some balls of copper therein. The cathode 130 is surrounded and shielded with a diaphragm 131, which is impermeable to metal ions. The inside of the diaphragm 143 is desirably filled with another liquid rather than the plating liquid, such as sulfuric acid at 15 to 20%. The cathode 130 and the conductive segment 127 are supplied a positive potential and a negative potential, respectively, from the first eliminator 132. Therefore, a flow of metal ions is formed as shown with the solid arrows. On the other hand, the anode 128 and the opposite conductive segment 126 are charged at a positive and a negative potential, respectively, from the other one, the second eliminator 129. Another flow of metal ions formed by the second eliminator 129 is shown with the white arrows.

According to the first and second aspects of the present invention, since undesirable plating is not adhered to the electric supply rollers for clamping the article to be plated on both sides, the electric supply rollers may be used for a long period of time and the cost therefore is decreased. The electric supply roller in contact with the article to be plated is kept under a clean condition for a long period of time. A large amount of current may be caused to flow to shorten a plating time, resulting in a cost reduction in the manufacture of the articles.

What is claimed is:

1. A continuous electroplating apparatus comprising:

a plating bath;

at least two rotary electrode shafts;

a rail between the rotary electrode shafts for mounting a planar article to be plated thereon;

an electric supply roller mounted on each of the rotary electrode shafts, the electric supply roller being divided into at least one conductive segment and at least one non-conductive segment;

an anode;

a cathode;

an electrical collection disk mounted on an upper portion of each of the rotary electrode shafts, the electrical collection disk corresponding to the electric supply roller mounted on the same rotary electrode shaft and having at least one conductive segment and at least one non-conductive segment in circumferential phase with the conductive segment and the non-conductive segment of the corresponding electric supply roller;

first eliminator electrically connected to the conductive segment of the electric supply roller in contact with the planar article and to the anode; and second eliminator electrically connected to the cathode and to the conductive segment of the electric supply roller at a distance from the planar article.

2. The continuous plating apparatus of claim 1, wherein said cathode is enclosed by a diaphragm.

3. The continuous plating apparatus of claim 1, wherein a boundary between the conductive segment and the non-conductive segment of the electric supply roller is vertical in a side face of the electric supply roller.

4. The continuous plating apparatus of claim 1, wherein said second eliminator is an eliminator which generates pulsed current.

* * * * *